US007160122B2

(12) United States Patent
Larsen et al.

(10) Patent No.: US 7,160,122 B2
(45) Date of Patent: Jan. 9, 2007

(54) POWER CONNECTORS AND CONTACTS

(75) Inventors: Robert D. Larsen, Oakville, CT (US); Lee M. Drozdenko, Bristol, CT (US)

(73) Assignee: Winchester Electronics Corporation, Wallingford, CT (US)

( * ) Notice: Subject to any disclaimer, the term of this patent is extended or adjusted under 35 U.S.C. 154(b) by 0 days.

(21) Appl. No.: 11/252,578

(22) Filed: Oct. 19, 2005

(65) Prior Publication Data

US 2006/0089043 A1 Apr. 27, 2006

Related U.S. Application Data

(60) Provisional application No. 60/622,018, filed on Oct. 27, 2004.

(51) Int. Cl.
*H01R 13/00* (2006.01)

(52) U.S. Cl. ..... 439/82; 439/751; 439/487

(58) Field of Classification Search ..... 439/82, 439/751, 485–487
See application file for complete search history.

(56) References Cited

U.S. PATENT DOCUMENTS

| | | | | |
|---|---|---|---|---|
| 2,969,517 | A * | 1/1961 | Gluck | 439/82 |
| 4,415,212 | A * | 11/1983 | DePillo | 439/82 |
| 5,115,375 | A * | 5/1992 | Garay | 361/760 |
| 5,387,138 | A * | 2/1995 | O'Malley | 439/751 |
| 5,499,933 | A * | 3/1996 | Sekine | 439/482 |
| 6,565,367 | B1 * | 5/2003 | Budman et al. | 439/82 |
| 6,736,668 | B1 * | 5/2004 | Kholodenko et al. | 439/487 |

* cited by examiner

*Primary Examiner*—Gary F. Paumen
(74) *Attorney, Agent, or Firm*—Rothwell, Figg, Ernst & Manbeck

(57) ABSTRACT

The present invention relates to electrical connectors, and, in particular, to power connectors and to improved contact structures and methods related thereto.

5 Claims, 8 Drawing Sheets

POWER CONNECTORS AND CONTACTS

This application claims the benefit of U.S. Provisional Patent Application No. 60/622,018, filed on Oct. 27, 2004, the contents of which are incorporated herein.

BACKGROUND OF THE INVENTION

1. Field of the invention

The present invention relates generally to electrical interconnection systems, and more specifically, to improved power connectors and contacts 2. Discussion of the Background A variety of power connectors are available in the art, such as, e.g., products by companies, such as, e.g., Winchester Electronics.

For example, Winchester Electronics offers a line of press-fit power terminals for backplane applications that feature C-Press® compliant pin technology. Winchester Electronics' press-fit power terminals may be used in wire-to-board power applications, such as, e.g., to provide a cost-effective and reliable method to connect lead wires terminated with ring or fork tongue terminals to backplanes. In some examples, power terminals have a DIP (Dual In-line Package) footprint and are available in 6 or 10 positions, with or without protective insulation, and with or without 6/32, 4/40, M3 or M4 mating screws. In addition, a 10-position power terminal with two 0.250 inch Quick Disconnect tabs is also available. Winchester Electronics offers a 121 Series, including, e.g., a 0.100×0.300 inch grid 10-position power terminals and a 0.125×0.250 inch grid 6-position power terminals.

In addition, Winchester Electronics offers a line of PC Power connectors that provide means of supplying low-to-mid range power for board-to-board applications. In some examples, PC Power connectors are available in 8, 12 and 30-position socket receptacles and pin headers. In addition, connector types are available in straight and right-angle solder terminations as well as in straight compliant press-fit terminations. In addition, compliant press-fit connectors are available for the standard press-fit PCB hole size of 0.64" and also in a 0.080" PCB hole size for the direct drop-in replacement of solder termination connectors.

PC Power compliant termination connectors utilize Winchester's unique C-Press® contact design. The press-fit installation of C-Press® contacts do not require soldering and, as a result, can be a more cost-effective means of board termination. In addition, C-Press contacts readily conform to plated through-holes and maximize mating surface area for reliable and effective board connections.

In addition, Winchester Electronics offers CompactPCI® Power Connectors that are designed to the requirements of PICMG® Power Interface Specification 2.11 R1.0 for use in connecting CompactPCI pluggable power supplies to backplanes in sub-rack equipment based on IEEE 1101.1, IEEE 1101.10, and VITA 30 packaging specifications.

In this regard, the PICMG Power Interface Specification recommends using 47-position power connectors in all new CompactPCI system designs, superseding prior practices incorporating either similar looking 38-position connectors or DIN 24+8 Type-M power connectors. Typical CompactPCI system packaging involves right-angle male connectors to be mounted onto daughtercards (e.g., free boards) and vertical female socket connectors to be mounted onto backplanes (e.g., fixed boards).

In addition, systems containing 3U power supplies utilize one mated pair, while systems containing 6U power supplies use two mated connector pairs. In addition, the 47-position CompactPCI Power Connector provides both versatility and performance through its combination of DC and AC power contacts.

As for backplane systems, some illustrative background backplane systems include a complex printed circuit board that is referred to as the backplane or motherboard, and several smaller printed circuit boards that are referred to as daughtercards or daughterboards that plug into the backplane. Each daughtercard may include a chip that is referred to as a driver/receiver. The driver/receiver sends and receives signals from driver/receivers on other daughtercards. For example, a signal path is formed between the driver/receiver on a first daughtercard and a driver/receiver on a second daughtercard. The signal path includes an electrical connector that connects the first daughtercard to the backplane, the backplane, a second electrical connector that connects the second daughtercard to the backplane, and the second daughtercard having the driver/receiver that receives the carried signal.

Previously, power socket contacts were often fabricated by the use of machining techniques (e.g., screw machining). However, such techniques have some limitations, such as, for example, fabrication costs.

A need exists in the art for improved power connectors and for improved power connector contacts and methods of fabrication of such connectors and contacts.

SUMMARY OF THE INVENTION

The present invention provides a power contact, a method of making the power contact, and a power connector that utilizes the power contact.

A power contact according to one particular embodiment of the present invention includes: an outer body comprising a c-shaped contact portion connected to a tubular main body; and a heat sink housed within the tubular main body, wherein an end of the tubular main body defines a cavity for receiving a contact.

A method, according to one particular embodiment for making the power contact, includes the steps of: providing an inner body; providing an outer body to be wrapped around the inner body; removing a corner portion of the outer body; wrapping the outer body around the inner body such that the step of wrapping the outer body around the inner body forms a c-shaped contact portion connected to a tubular main body that houses the inner body.

A method, according to another particular embodiment for making the power contact, includes the steps of: obtaining an electrically conductive sheet of material; and feeding the sheet into a progressive die, wherein the progressive die is configured to: (a) form a generally rectangular outer body from the sheet, wherein the outer body remains connected to the sheet by a small portion of the sheet; (b) cut away a corner portion of the rectangular outer body; (c) dispose an inner body on a major face of the outer body; and (d) tightly wrap the outer body around the inner body to form a power contact having (i) a tubular main body that houses the inner body and (ii) a c-shaped contact connected to the tubular main body.

A power connector according to one particular embodiment of the present invention includes: a body having a plurality of holes, wherein each of the plurality of holes houses a power contact according to an embodiment of the invention. The power connector may be connected to a circuit board having a plurality of plated through holes, each of which is electrically connected to a power source, such that each of the plurality of power contacts is pressed into a corresponding one of the plated through holes.

The above and other features and advantages of the present invention, as well as the structure and operation of preferred embodiments of the present invention, are described in detail below with reference to the accompanying drawings.

BRIEF DESCRIPTION OF THE DRAWINGS

The accompanying drawings, which are incorporated herein and form part of the specification, help illustrate various embodiments of the present invention and, together with the description, further serve to explain the principles of the invention and to enable a person skilled in the pertinent art to make and use embodiments of the invention. In the drawings, like reference numbers indicate identical or functionally similar elements.

DETAILED DESCRIPTION OF PREFERRED EMBODIMENTS

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

Figure 1A:
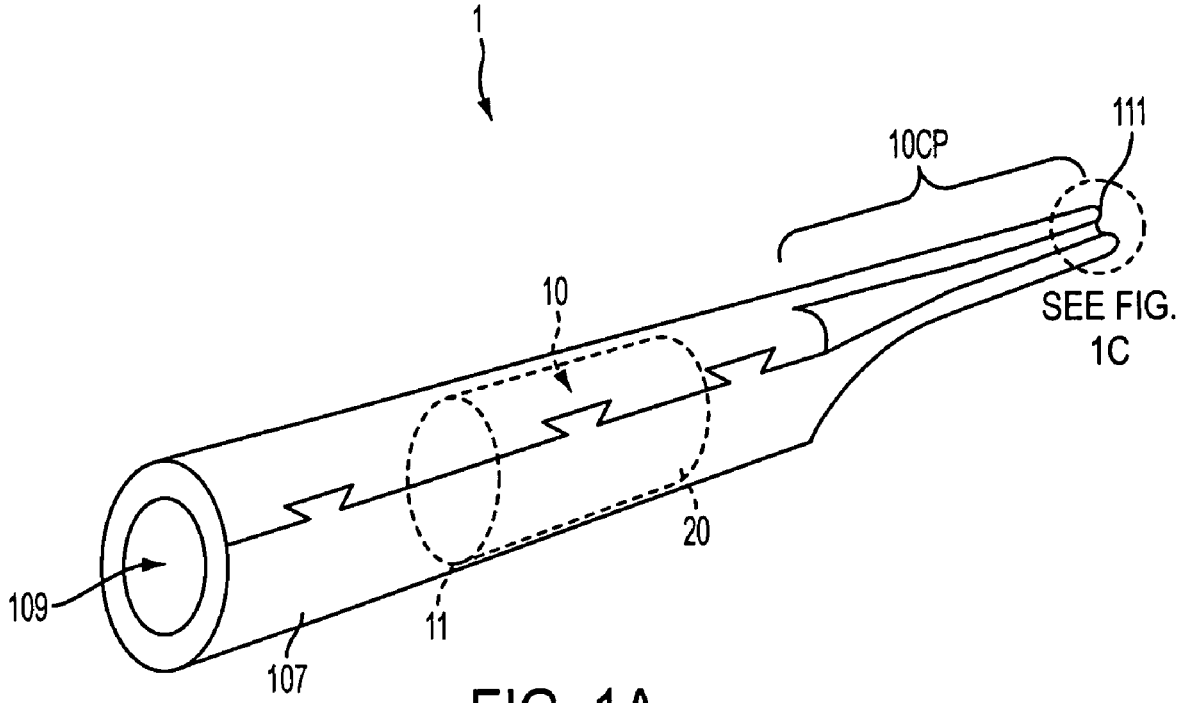
FIG. 1(A) is a perspective view of a power contact according to some embodiments of the invention.
Figure 1B:
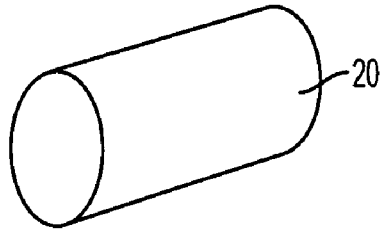
FIG. 1(B) is a perspective view of a heat sink component according to some embodiments of the invention.

FIGS. 1(A)–1(B) show an illustrative embodiment of a power contact 1. In the illustrative embodiment, the contact 1 includes two components: (a) an outer body 10 and (b) an inner body 20. The outer body 10 is preferably formed from a metal sheet (such as, e.g., an alloy made with, e.g., brass and/or copper or the like), such as, e.g., a stamped metal sheet. In some illustrative embodiments, the body 10 can be made from a sheet having a thickness of about 0.01 inches to 0.03 inches, or in some embodiments, about 0.020 inches to 0.025 inches.

Inner body 20 is preferably fabricated so as to be similar to a dowel pin, such as, e.g., substantially solid and substantially cylindrical in some embodiments. Preferably, inner body 20 is configured to operate as a heat sink so as to adsorb or dissipate heat from body 10. Accordingly, body 20 is preferably made from a heat absorbing material (such as, e.g., a metal or other heat absorbing material).

In some embodiments, the contact 1 can be sized so as to be used within applications similar to any of the connector contact applications described above under the section entitled Background of the Invention.

Among other things, the embodiment shown in FIGS. 1(A) to 1(B) can significantly reduce costs of manufacture. By way of example, costs for contact manufacture could be reduced by over 50%–80% or even more.

In some embodiments, contact 1 consists of a contact portion 10CP and a main body 11. Contact portion 10CP may be configured to provide a c-shaped compliant end 111 that can, e.g., be fitted into a plated through hole ("via") of a circuit board or the like. In some embodiments, contact portion 10CP is generally elongate and c-shaped along its entire length. Alternatively, other configurations of the end can be employed, such as, e.g., I-shaped configurations and/or any other known configurations for compliant and/or other connections. In some embodiments, main body 11 is generally in the form of a tube having a generally circular cross section. Accordingly, an end 107 of contact main body 107, which end 107 is opposite of end 111, defines a cavity 109 for receiving an electrical contact (not shown).

In some illustrative embodiments, a contact 1 can be fabricated using some or all of the following steps, as illustrated in FIGS. 2(A)–(G).

First, a sheet of material 202 (see FIG. 2A) is obtained. In some embodiments, the thickness of the sheet ranges between 0.01 and 0.03 inches.

Figure 2A:
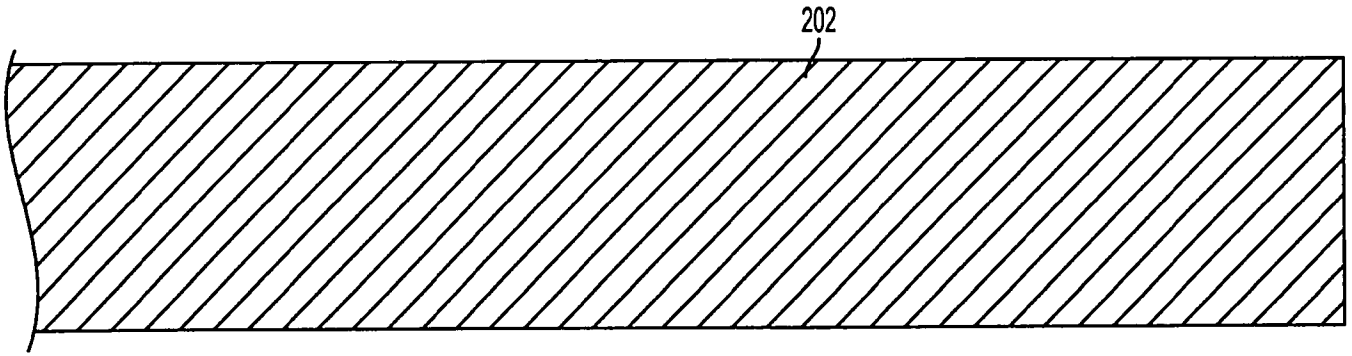
FIGS. 2(A)–(G) illustrate a process for making the contact shown in FIG. 1(A).
Figure 2B:
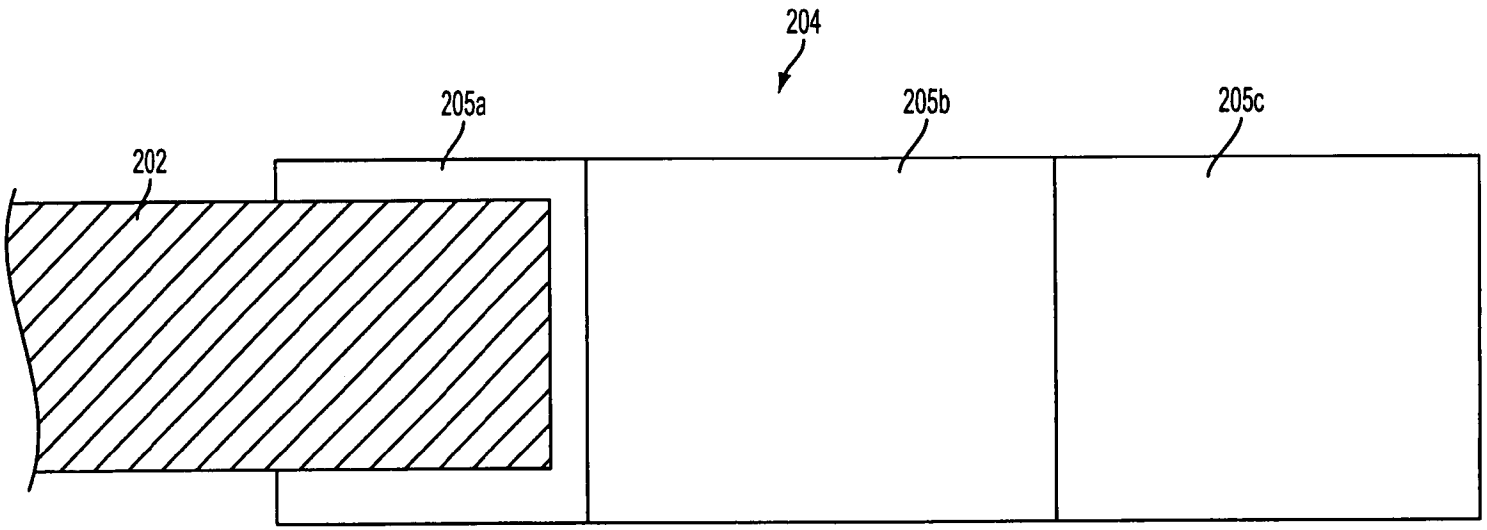

Second, the sheet of material 202 is fed into a progressive die 204 (see FIG. 2B). In some embodiments, progressive die 204 includes a plurality of die units (e.g., die units 205*a–c*).

Figure 2C:
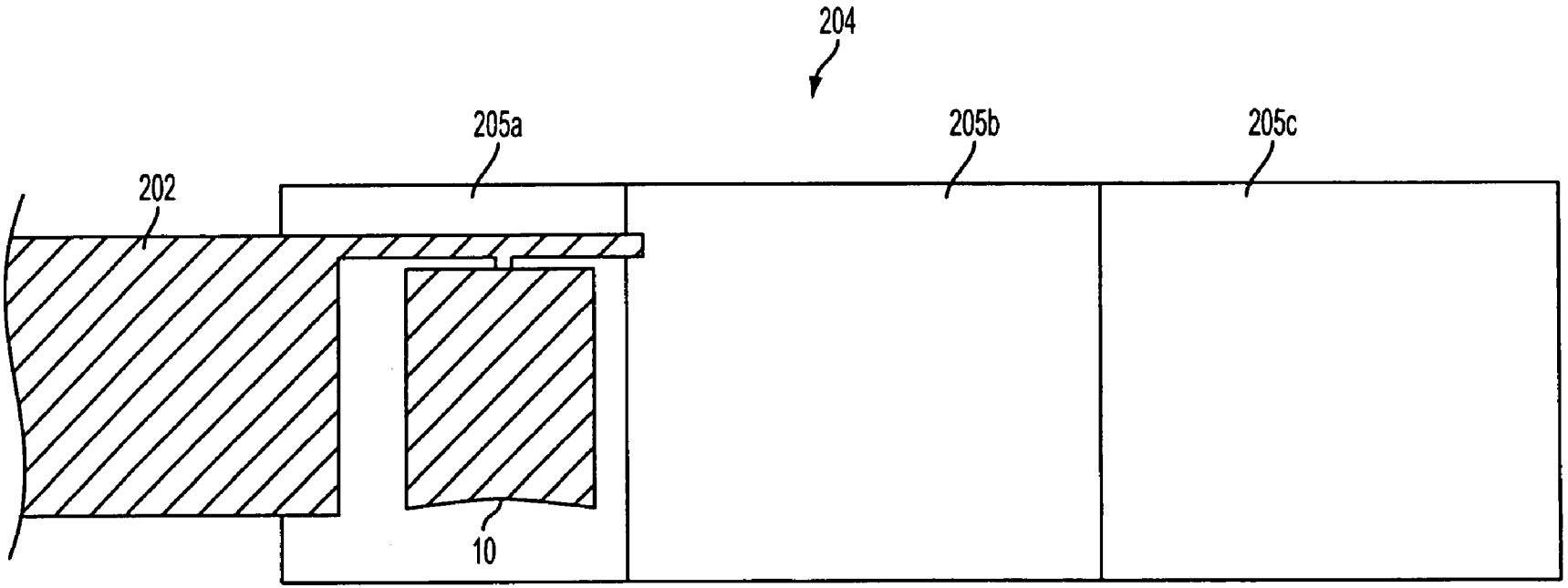

Third, a first die unit (e.g., unit 205*a*) of progressive die 204 forms an outer body 10 from sheet 202 (see FIG. 2C). The die unit may form body 10 by removing portions of sheet 202 by, for example, a cutting or stamping operation. As illustrated in FIG. 2C, body 10 may be attached to sheet 202 by a small piece 209 of sheet 202.

Figure 2D:
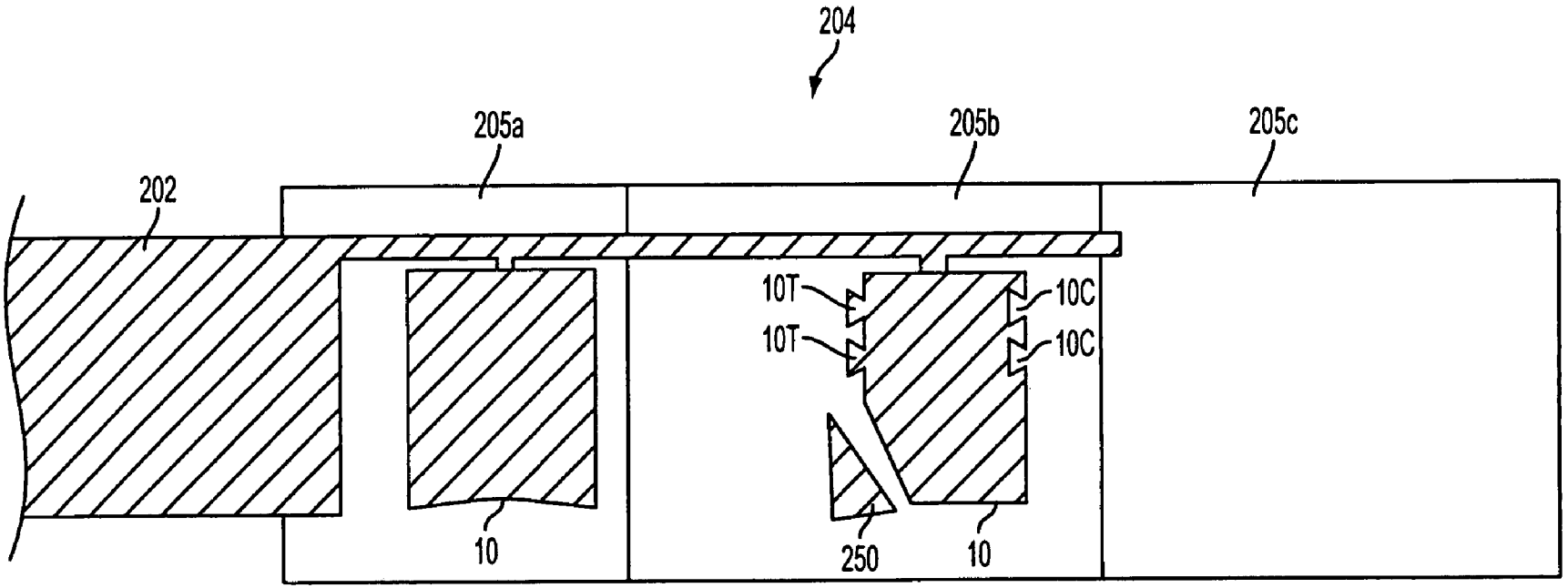

Fourth, in some embodiments, a second die unit (e.g., unit 205*b*) may form dove tail tabs 10T on one side of body 10 and may form corresponding dove tail cut-outs 10C on the opposite side of body 10 (see FIG. 2D). Additionally, die unit 205*b* or another die unit may also remove a portion 250 of the body 10 from a corner of body 10 as shown in FIG. 2D. The portion of body from which portion 250 is removed is used to form the contact portion 10CP. By removing corner piece 250, the resulting contact portion 10CP can be formed into a tapered or narrowed shape.

Figure 2E:
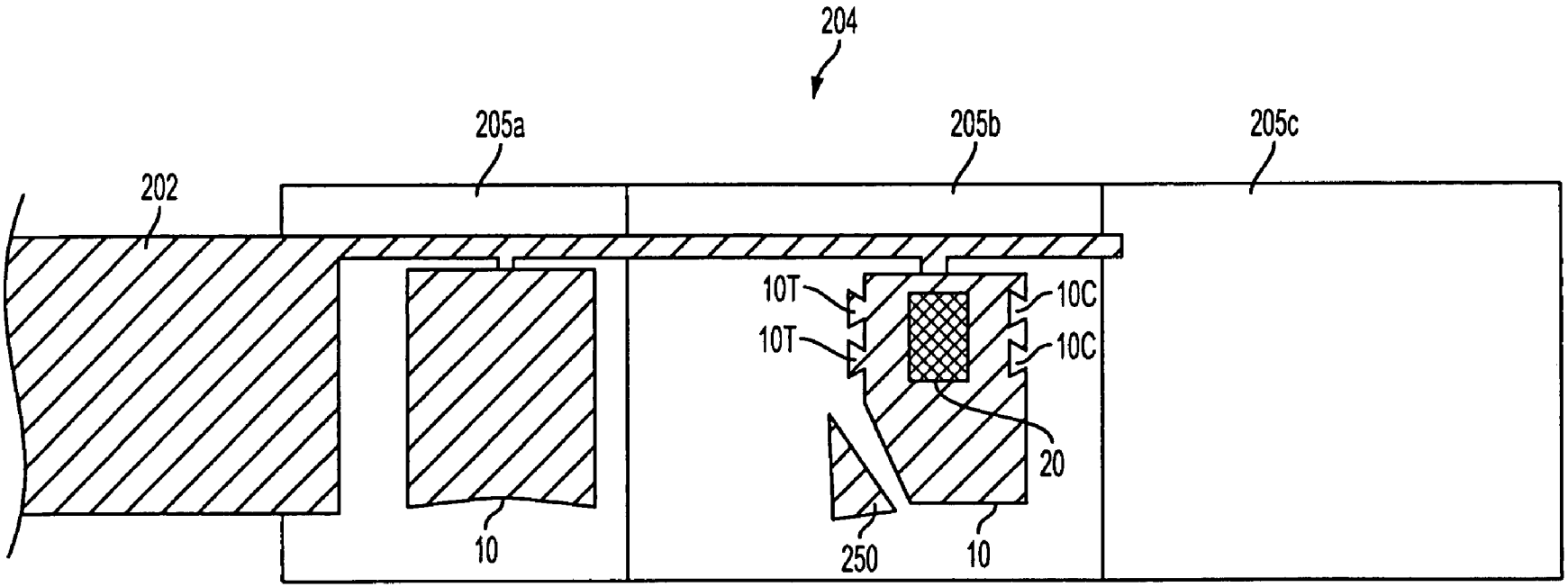

Fifth, an inner body 20 is directed or fed into a position proximate the outer body 10. For example, the body 20 may be placed on major face of the outer body 10 as shown in FIG. 2(E).

Figure 1C:
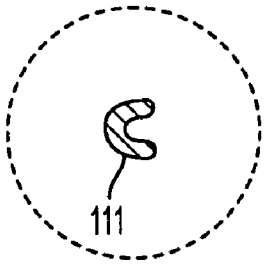
FIG. 1(C) is an end view of the contact shown in FIG. 1(A).
Figure 2F:
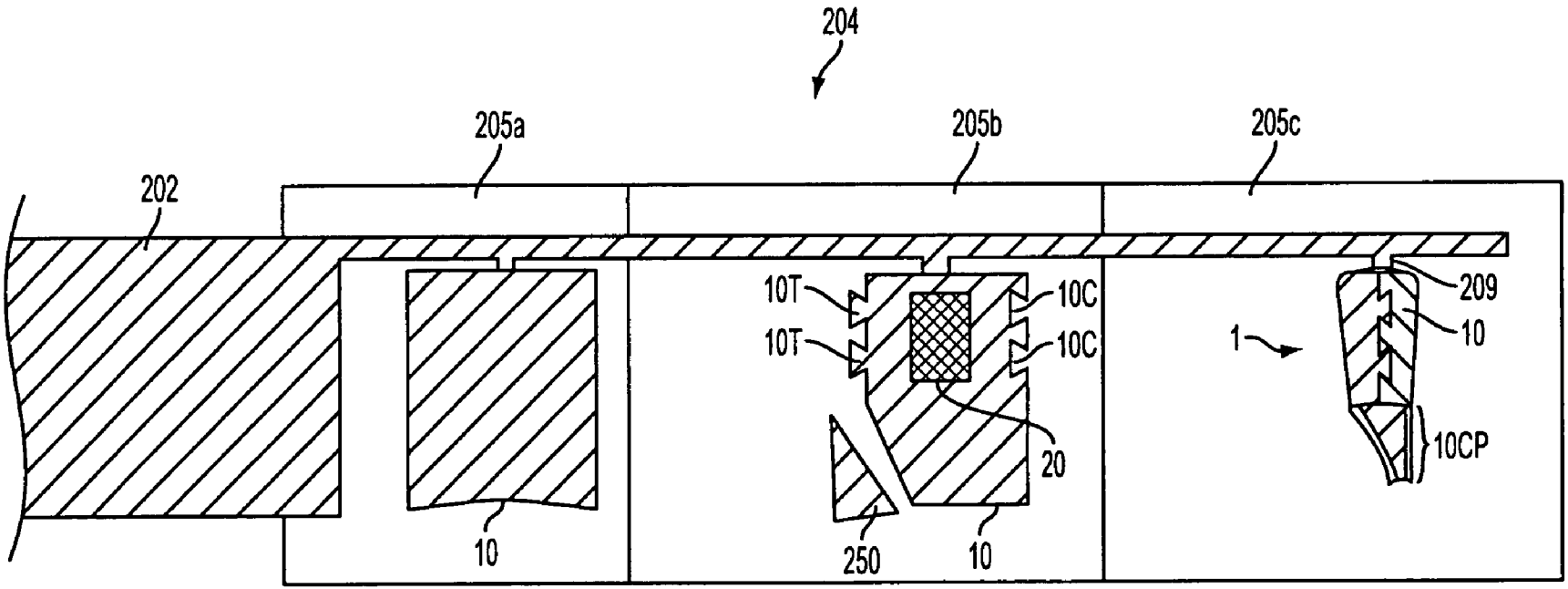

Sixth, a die unit (e.g., unit 205*c*) folds outer body 10 around the inner body 20 so that body 20 is encased by body 10 (see FIG. 2F). Preferably, body 10 is tightly wrapped around body 20 such that body 20 is substantially unable to move relative to body 10. In some embodiments, just like the outer body is wrapped around the body 20, the contact portion 10CP of the contact 1 can be rolled into a substantially C-shape cross-sectional configuration, such as, e.g., shown in FIGS. 1(A) and 1(C), wherein FIG. 1(C) shows an illustrative end view of end 111 shown in FIG. 1(A) showing a generally c-shaped structure.

In some embodiments, the contact portion 10CP can be formed substantially or generally concurrently with or subsequent to the wrapping of the outer body around the body 20. In various other embodiments, as indicated above, other types of contact shapes can be formed in the contact portion 10CP as may be desired.

In some embodiments, as shown in FIG. 1(A), after being wrapped around body 20, body 10 can be retained in the cylindrical configuration shown in FIG. 1(A) by providing an engagement means, such as, e.g., a mechanical connection, such as, e.g., a mechanical interlock, such as, e.g., a dove-tail tab and cut-out connection mechanism as shown. In some alternative embodiments, by way of example, the outer body could be welded together, crimped together and/or the like. Among other things, such a mechanical connection can facilitate the fabrication process of the connector contact, especially in environments where such contacts are fabricated so as to have minute sizes, such as, e.g., in various connectors described herein-above in the Background of the Invention.

Figure 2G:
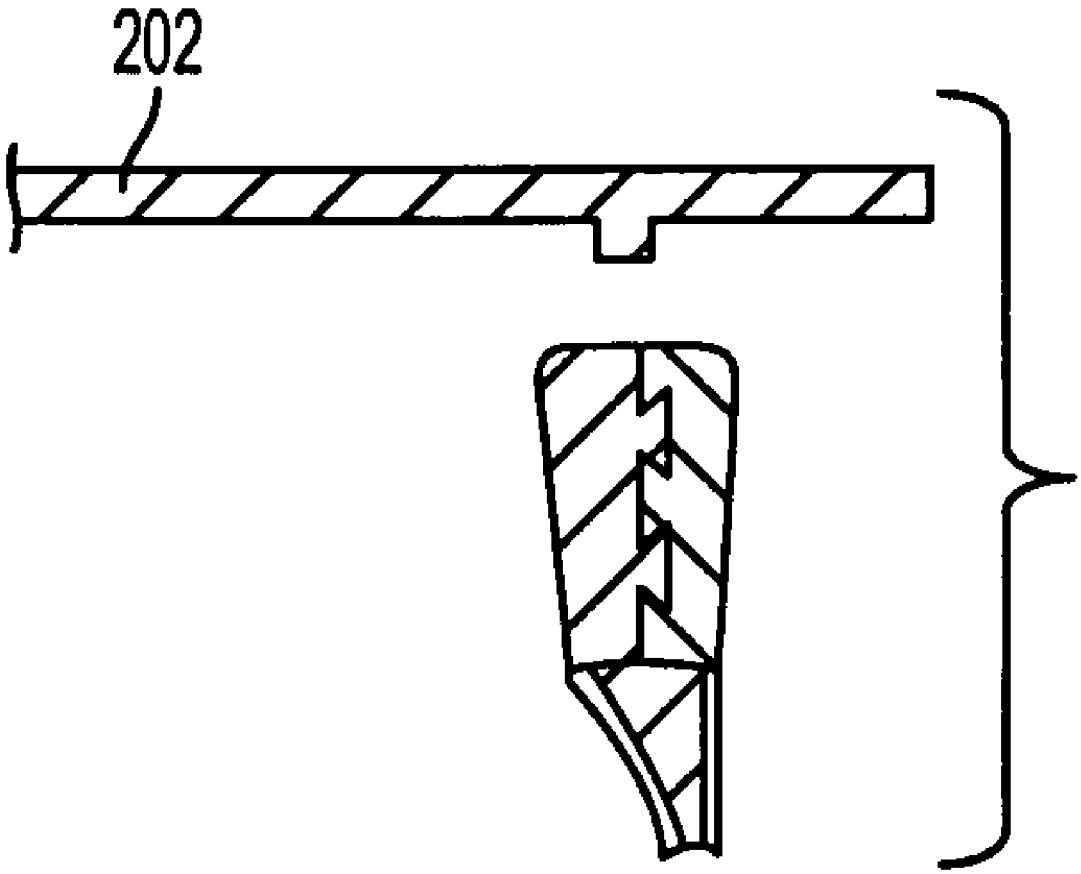

Seventh, after (or before) the wrapping step, body 10 can be separated from the sheet 202 (see FIG. 2G).

Substantially all, or all, of the foregoing steps for creating contact 1 may be carried out by the progressive die 204, but this is not a requirement.

Figure 3A:
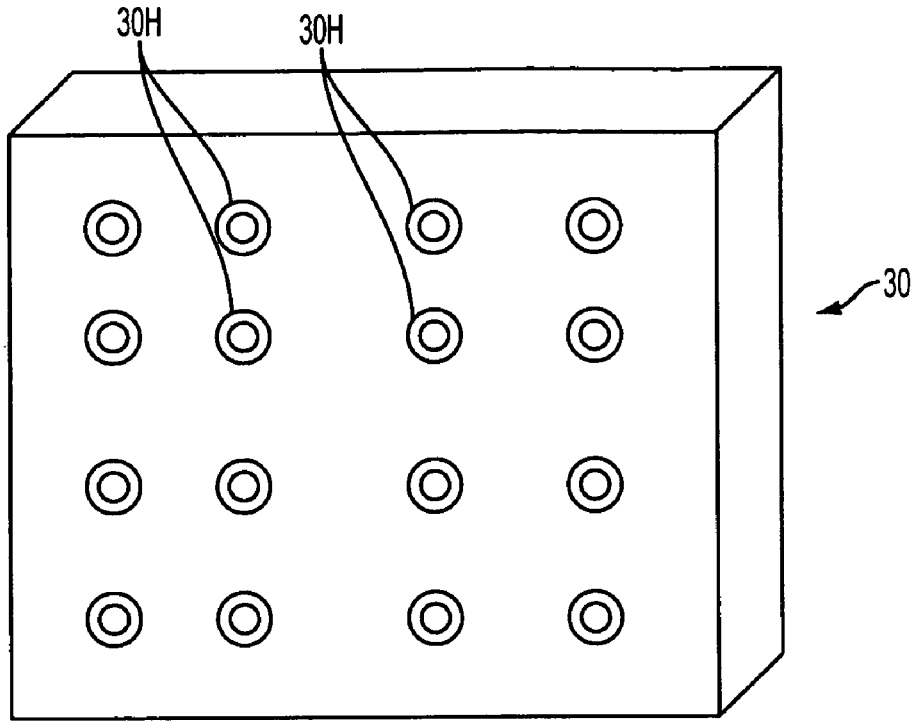
FIG. 3(A) is a perspective view of an illustrative power connector according to some embodiments of the invention.
Figure 3B:
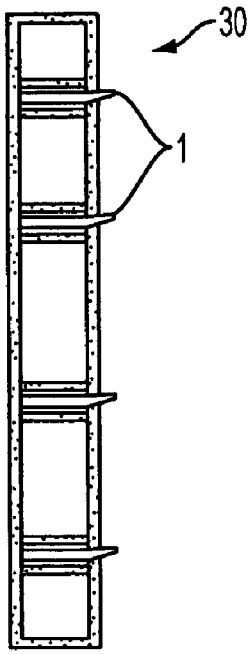
FIG. 3(B) is a side view of the power connector shown in FIG. 3(A).

FIGS. 3(A), (B) and (C) show exemplary environments in which a plurality of contacts 1 similar to that shown above can be implemented within an illustrative connector. In the illustrative embodiment, an illustrative connector includes a housing 30 (which can be, e.g., made with, e.g., an insulating or dielectric material), and includes a plurality of through-holes 30H configured to receive and house respective contacts 1. In some embodiments, the contacts 1 can be snap-fit or press-fit into the respective through-holes 30H.

Figure 3C:
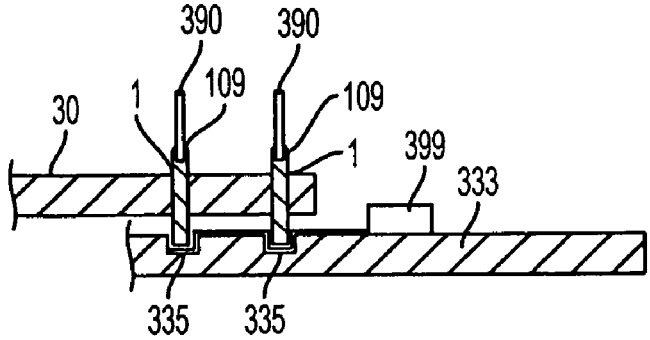
FIG. 3(C) illustrates a use of the power connector shown in FIGS. 3(A)–(B).

As shown in FIG. 3(C), in operation, contacts 1 are housed in body 30 and end 111 of each contact 1 is inserted (e.g., press fit) into a plated through hole 335 of a circuit board 333, and a contact 390 is inserted into the contact receiving end 109 of each power contact 1. In preferred embodiments, plated through hole 335 is electrically connected to a power source 399 (e.g., a battery or electrical outlet or other power source). Accordingly, each power contact 1 functions to electrically connect a contact 390 with the power supply.

While various embodiments/variations of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

Additionally, while the process described above is described as a sequence of steps, this was done solely for the sake of illustration. Accordingly, it is contemplated that some steps may be added and other steps omitted, and the order of the steps may be re-arranged.

What is claimed is:

1. A power contact, comprising:

an outer body comprising an c-shaped compliant contact portion connected to a tubular main body wherein said c-shaped compliant contact portion is adapted to be inserted into a circuit board hole; and a heat sink housed within the tubular main body, wherein an end of the tubular main body defines a cavity for receiving a contact.

2. The contact of claim 1, where said heat sink is made with metal.

3. The contact of claim 1, where said outer body is made with metal.

4. The contact of claim 1, where said outer body is made with an alloy including brass and/or copper.

5. The contact of claim 1, wherein the tubular main body is formed from a generally rectangular piece of metal having dove tail tabs on one side thereof and corresponding dove tail cut-outs on the opposite side thereof.

* * * * *